United States Patent [19]

Day

[11] 4,009,539

[45] Mar. 1, 1977

[54] LAPPING MACHINE WITH VACUUM WORKHOLDER

[75] Inventor: Lawrence Day, Mount Prospect, Ill.

[73] Assignee: Spitfire Tool & Machine Co., Inc., Chicago, Ill.

[22] Filed: June 16, 1975

[21] Appl. No.: 587,140

[52] U.S. Cl. ..... 51/131; 51/235

[51] Int. Cl.[2] ..... B24B 37/04

[58] Field of Search ..... 51/131, 133, 235, 237 M; 269/21

[56] References Cited

UNITED STATES PATENTS

| | | | |
|---|---|---|---|
| 631,856 | 8/1899 | Marsh | 51/235 |
| 631,857 | 8/1899 | Marsh | 51/235 |
| 1,198,402 | 9/1916 | Bagnall | 51/235 |
| 3,294,392 | 12/1966 | Dunham | 51/235 X |
| 3,747,282 | 7/1973 | Katzke | 51/235 |
| 3,841,028 | 10/1974 | Katzke | 51/235 X |

OTHER PUBLICATIONS

Western Electric, Technical Digest No. 7, "Porous Plug Vacuum Plate", July 1967.

*Primary Examiner*—Al Lawrence Smith
*Assistant Examiner*—Nicholas P. Godici
*Attorney, Agent, or Firm*—Edward C. Threedy

[57] ABSTRACT

A lapping machine comprising a removable workholder adapted to be mounted through a vacuum system upon a supporting arm rotatable about a horizontal axis, with the vacuum system functioning to retain a workpiece upon the workholder as the same is rotated with the arm relative to a rotatable lap of the machine.

8 Claims, 11 Drawing Figures

LAPPING MACHINE WITH VACUUM WORKHOLDER

SUMMARY OF THE INVENTION

A multiple work station lapping machine of the type employing a number of work-supporting and positioning arms incorporating a vacuum system for holding a workpiece upon a carrier as the latter is moved into and out of a work position.

The workpiece carrier, which is portable so as to be preloaded, is held upon a pressure pad carried by the work-supporting and positioning arm, by a vacuum system as the work-supporting and positioning arm, by a vacuum system as the work-supporting and positioning arm is vertically and horizontally moved and the pressure pad is rotated about a horizontal axis into and out of engagement with the rotatable lap of the lapping machine.

The movable work-supporting and positioning arms may be of the type shown and described and claimed in U.S. Pat. No. 3,032,937. However, the present invention is not to be limited by such patent, and any method of horizontally and vertically moving a work-supporting arm, as such, may be readily incorporated within the concept of the present invention.

Through the use of the present invention which has for its primary purpose the lapping and/or polishing of wafers and substrates of a relatively thin and fragile nature, the present invention is directed to a lapping machine wherein a pressure pad may be positioned so as to lie in a horizontal plane and be free to receive a carrier, which in turn is then held upon the pressure pad through a vacuum system while the pressure pad and carrier are rotated through 180° into an oppositely directed horizontal plane.

The carrier consists of a metallic tray-like element provided with a plurality of porous inserts corresponding in size to the wafer or substrate being machined. The wafer is placed upon the porous insert and becomes fixed thereto through the vacuum system which extends through the pressure pad and has communication with the porous inserts so as to hold the workpiece onto the tray while the same is moved into a lapping position as heretofore identified.

GENERAL DESCRIPTION

The invention will be best understood by reference to the accompanying drawings showing the preferred embodiment of the invention, and in which.

Figure 1:
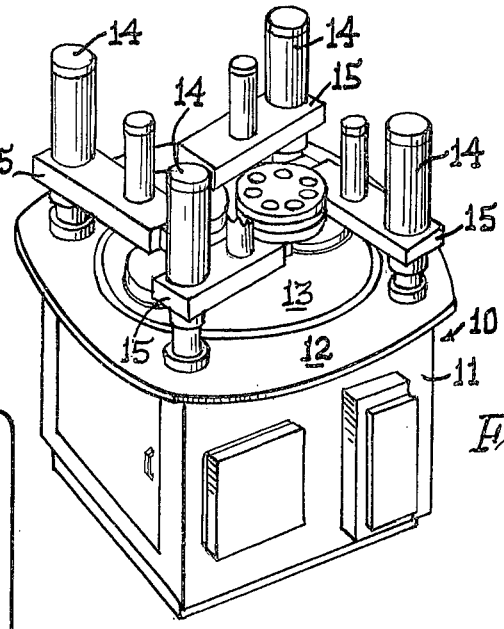
FIG. 1 is a perspective view of the four-station lapping and polishing machine.

Referring to FIG. 1 of the drawings, there is shown a multiple position lapping machine 10, which comprises a base 11 supporting a horizontally disposed skirt 12 surrounding a rotatable lap plate 13. Carried by the skirt 12 are a plurality of vertical hollow standards 14 which house a cylinder (not shown) for raising and lowering a horizontally disposed supporting arm 15.

The general construction of the vertical standard 14 and the cylinder for raising and lowering the supporting arm 15 is of the type generally shown and described in U.S. Pat. No. 3,032,937.

Figure 2:
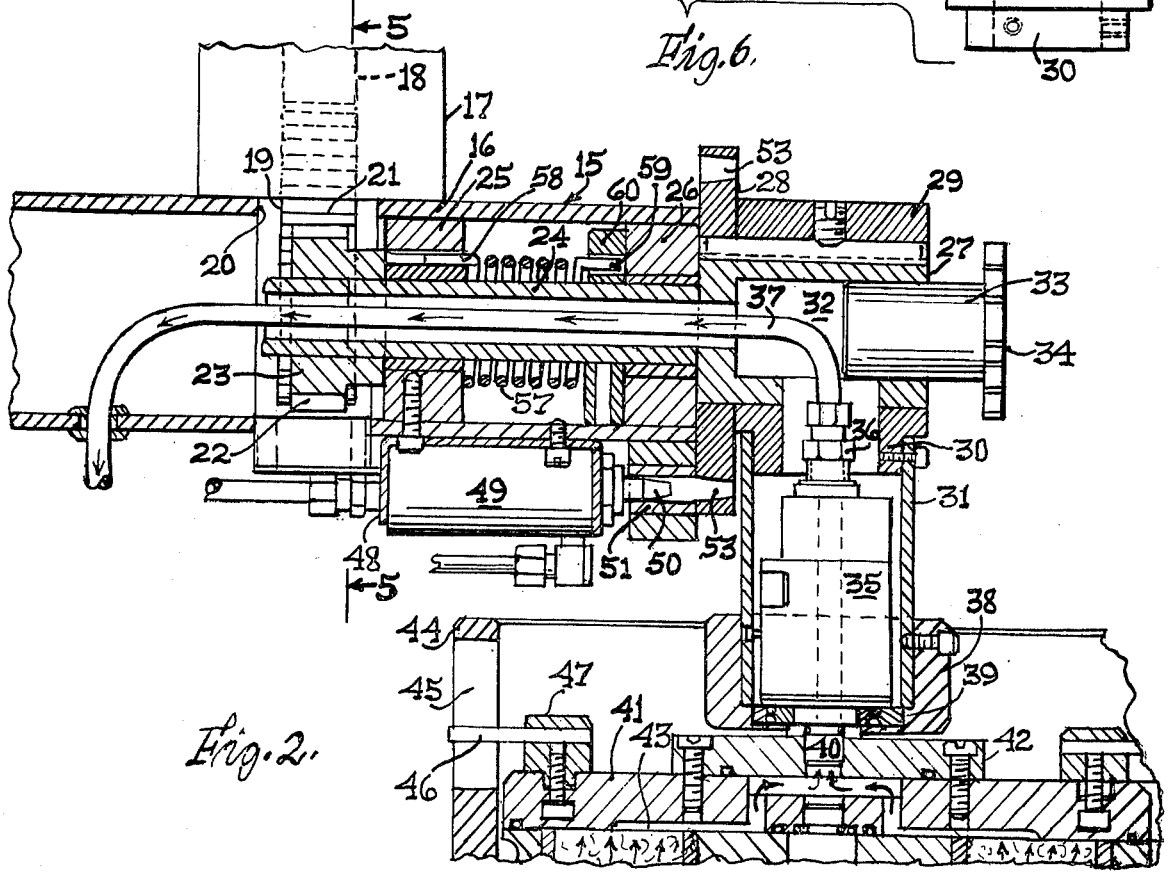
FIG. 2 is a fragmentary detailed sectional view of one end of one of the work stations showing in sectional detail the interrelation of the components of the invention.

Each of the supporting arms 15 comprises a horizontal hollow housing 16 generally rectangular in cross section. Carried upon the upper wall of the housing 16 is a vertically extending casing 17 housing a two-way pneumatic cylinder, the movable piston 18 of which is shown in part in FIGS. 2 and 4.

As shown, the free end of the movable piston 18 is provided with a rack 19 which is adapted to project through an opening 20 formed in the top wall of the housing 16. The teeth 21 of the rack 19 are adapted to have interengagement with the teeth 22 of a pinion 23. The pinion 23 is fixedly attached to one end of an elongated hollow tube 24 which is supported within the hollow housing 16 by bearing blocks 25 and 26.

The tube 24 provides an enlarged circular hub 27 which projects outwardly of the free end of the hollow housing 16. Journalled upon the hub 27 and adjacent to the free end of the housing 16, is a circular indexing plate 28, the diameter of which is such that a portion of the circumference of the plate 28 will extend beyond the top and bottom walls of the housing 16.

Also journalled upon the hub 27 outwardly of the plate 28, is a retaining block 29. This block 29 provides on its bottom surface a reduced collar 30 which in turn has connected thereto a hollow sleeve 31.

The block 29, as well as the collar 30, is provided with an internal cavity 32 which has open communication with the interior of the elongated tube 24 as well as the sleeve 31. Closing the end of the hub 27 and forming a wall portion for the cavity 32, is the insert end 33 of a circular handle 34.

Within the sleeve 31 is a Deublin union 35 which provides at one end suitable connectors 36 for attaching thereto one end of a pneumatic tube 37. This tube 37 extends through the cavity 32 as well as the elongated tube 24 and through a portion of the hollow housing 16 of the arm 15 and is connected to a suitable vacuum-creating mechanism (not shown).

The sleeve 31 supports a ring 38 which in turn supports a spherical ball bearing 39, through which is journalled a hollow rotatable connecting shaft 40.

Adapted to be connected to the rotatable shaft 40 of the union 35 is a pressure pad 41. As shown there is mounted upon the upper surface of the pressure pad 41 a block 42 which provides a center opening into which the rotatable shaft 40 is projected and connected. The underside of the pad 41 is provided with a series of channels 43 which in turn have open communication with the hollow rotatable shaft 40 of the union 35 and through which there is created a vacuum in a manner well-known in the art.

Adapted to surround the pressure pad 41 is a circular retaining wear ring 44. This wear ring 44 is provided with a series of slots 45 into which freely project the free ends of a retaining pin 46. These pins 46 are, through a mounting block 47, connected to the upper surface of the pressure pad 41, as shown. Through the employment of the retaining pins 46 extending into the slots 45, the work-retaining ring 44 is connected to the pressure pad 41.

Mounted to the underside of the hollow housing 16 of the arm 15 by a bracket 48, is a double-acting air cylinder 49. The air cylinder 49 includes a piston pin 50 which is adapted to be movably contained within a bearing 51 journalled within an opening formed in a supporting fixture 52 carried by the bottom wall of the housing 16. The bearing 51 is so positioned with respect to the bottom wall of the housing 16 so as to lie in a horizontal plane coaxially with one of a pair of holes 53 formed in the indexing plate 28. It should be noted that these holes 53 are spaced 180° apart for a purpose hereinafter made apparent.

Figure 3:
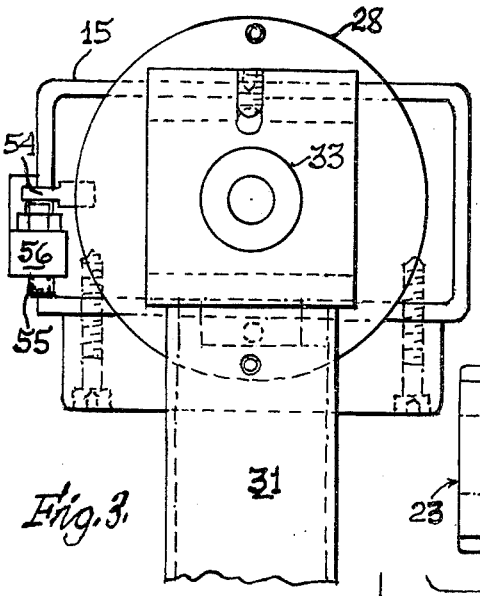
FIG. 3 is a fragmentary end view of one of the supporting arms of one of the work stations.
Figure 6:
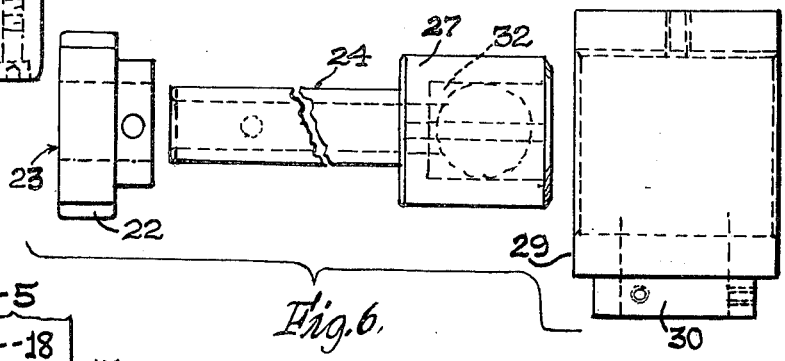
FIG. 6 is a plan view of certain elements of the invention in exploded relation.

Referring to FIG. 3, there is shown a stop pin 54 carried on the periphery of the indexing plate 28, positioned 90° from each of the holes 53 and extending radially beyond the periphery of the indexing plate 28. This stop pin 54 is adapted to have contact with an adjustable bolt 55 threadable through a housing 56 mounted on one side wall of the housing 16. Through this stop pin 54 and adjustable bolt 55, the rotation of the indexing plate 28 in the manner hereinafter described, will be controlled.

Again referring to FIGS. 2 and 4, it is seen that there is a tension spring 57 coiled about the elongated tube 24. One end 58 of the spring 57 projects into the opening formed in the bearing 25 so as to be held in a fixed position. The other end 59 of the tension spring 57 is journalled in a slot formed in a disc 60 which is pressfitted upon the tube 24 so as to be rotatable therewith in the manner hereinafter described.

The Workpiece Carrier

Referring to FIGS. 7 through 11 inclusive, there is shown the workpiece-carrying member 61 which consists of a traylike element constructed from a suitable metallic material and being substantially flat and circular in configuration. The workpiece-carrying member 61 is generally of a size equal to that of the pressure pad 41, but need not be so restricted. The workpiece-carrying member 61 is a separate portable element from the machine 10 so that it is readily positioned upon the pad 41 of such machine when it is desired to be used.

Figure 8:
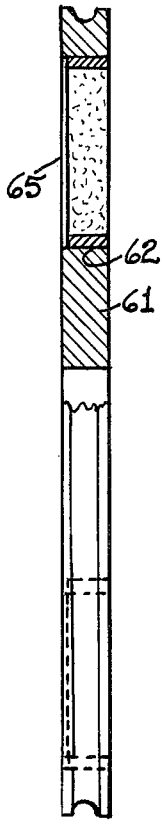
FIG. 8 is a detailed sectional view taken on line 8—8 of FIG. 7.
Figure 9:
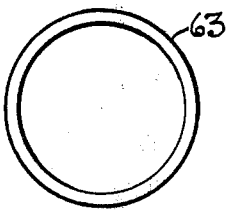
FIG. 9 is a plan view of a retaining ring as employed in the carrier.
Figure 10:
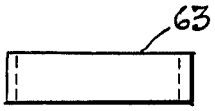
FIG. 10 is a side elevational view of the retaining ring.
Figure 11:
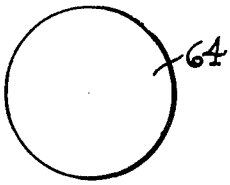
FIG. 11 is a plan view of the porous insert as employed in the carrier.

The workpiece-carrying member 61 is provided with a plurality of circular openings 62 which are defined by a ring 63 pressfitted into the openings 62 so as to be contained therein. Fixedly positioned within the ring 63 is a circular porous element 64. It is preferred that the porous element 64 by of a thickness slightly less than the depth of the ring 63 so as to provide an area for the reception of the wafer-like workpiece 65 (FIG. 8).

From the foregoing it is readily apparent that the workpiece-carrying member 61 may be pre-loaded with a plurality of workpieces 65 at a work station remote from the machine 10 and be readily placed upon the pad 41 when in use.

The porous element 64 may be of any stable material of such porousity that a vacuum may be created therethrough to effectively hold the workpiece 65 thereon during the rotation about a horizontal axis of the pressure pad 41 in a manner hereinafter described. The ring 63 may be constructed of such material as to act as a guide or limit to the polishing action on the workpiece 65 which is inserted therein and upon the porous element 64.

Operation

Figure 4:
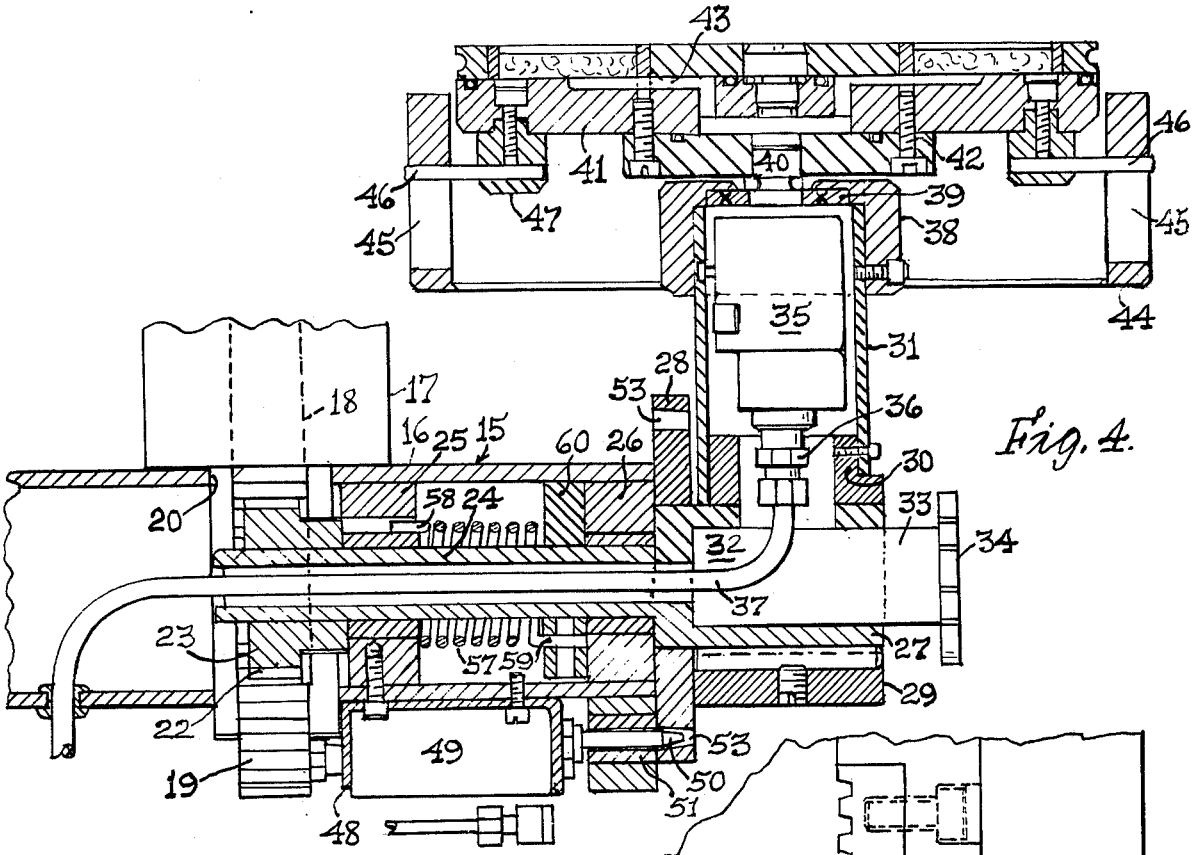
FIG. 4 is a fragmentary detailed sectional view similar to FIG. 2, but showing the arm in its fully rotated position.
Figure 5:
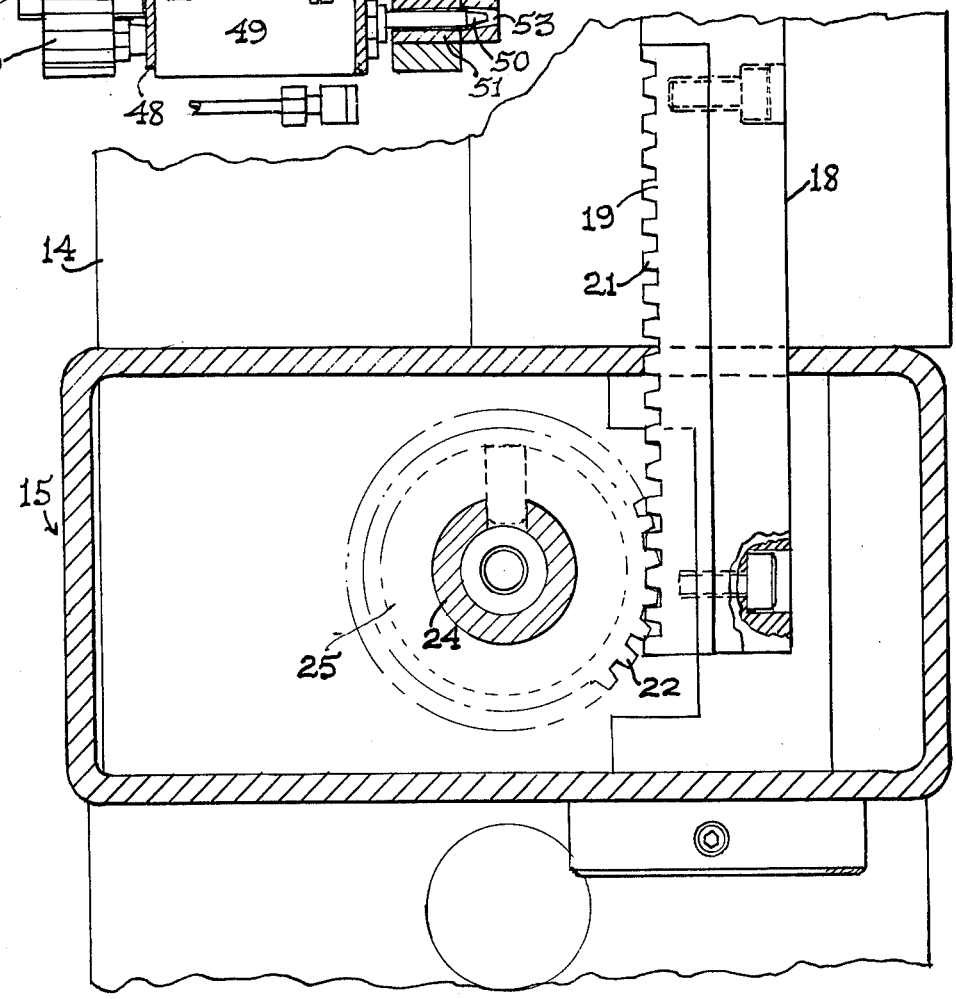
FIG. 5 is a fragmentary detailed sectional view taken substantially on line 5—5 of FIG. 2.
Figure 7:
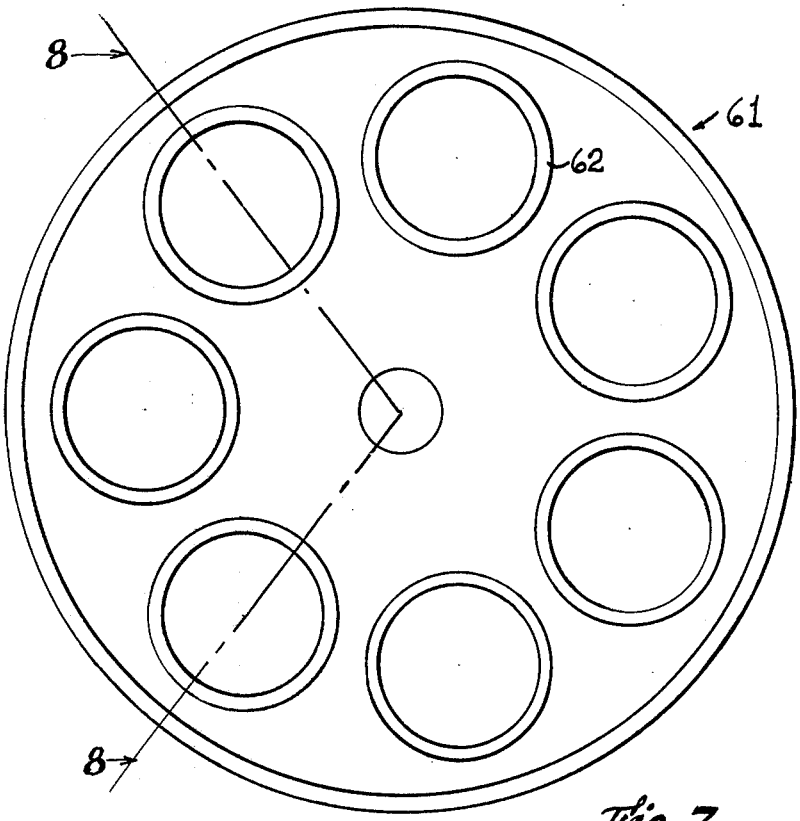
FIG. 7 is a plan view of the workpiece carrier as employed in this invention.

In the normal operation of the machine, the work stations will be caused to be placed in a position such as illustrated in FIG. 4. In such position the pressure pad 41 as well as the retaining ring 44 are such that they lie in a horizontal plane and face in an upward direction. The retaining ring 44 has moved down upon the pins 46 as the same project through the slots 45 formed in the ring 44, so as to leave in an exposed condition the flat channeled surface of the pad 41. The components of the machine are held in such a position by the pin 50 which has been expelled out of its air cylinder 49 such that it projects into one of the openings 53 formed in the indexing plate 28.

The pressure pad 41 and its associated parts have been rotated about a horizontal axis into the position shown in FIG. 4, by the actuation of the pneumatic cylinder carried within the casing 17 supported by the housing 16. The movable piston 18 of such cylinder has been effectively expelled therefrom such that the rack 19 carried by the free end of the piston 18 has been caused to rotate the pinion 23, which in turn has rotated the tube 24 and the associated parts connected thereto, all in the manner shown in FIG. 4.

The workpiece-carrying member 61 which has been pre-loaded with suitable workpieces 65, is then placed on the upwardly directed exposed surface of the pressure pad 41 and, by the vacuum created through the channels 43 formed in such exposed surface of the pressure pad 41 and the porous elements 64 of the workpiece-carrying member 61, the workpiece 65 as well as the carrying member 61 will be secured to the exposed surface of the pressure pad 41 and be held thereon while the same is rotated into a working position. After the workpiece-carrying member 61 has been placed upon the pad 41, the piston 18 of the mechanism is activated so as to cause the rack 19 to rotate the pinion 23 so as to rotate the mechanisms associated therewith through 180° until the stop pin 54 carried by the index plate 28 engages the adjustable stop bolt 55, at which time the mechanisms will be in the condition shown in FIG. 2. In such condition the retaining ring 45 will now have moved to its lowermost position where it encircles not only the pressure pad 41, but also the workpiece-carrying member 61 as these parts are then caused to engage the surface of the lap plate 13.

The vacuum is maintained through the system during the operation so as to hold the workpieces 65 upon the porous elements 64 of the workpiece-carrying member 61, and the member 61 upon the pad 41, while the same are caused to be rotated together about a horizontal axis as defined by the supporting arm 15. While the pad 41 and carrying member 61 are secured together by the vacuum system, they, together with the workpieces 65, are by the union 35 permitted to be rotated as a reaction to the rotatable movement of the lap 13.

To maintain the smooth rotation of the pressure pad 41 and retaining ring 44 as well as the workpiece-carrying member 61, the movement of these components is controlled by the coil spring 57 exerting a rotation resistance to the movement of such parts under action of the rack 19 and piston 23.

From the foregoing it is apparent that there has been disclosed a lapping machine which includes a vacuum system for holding workpieces in position between a pressure pad and a lap plate during lapping or polishing operation, with the workpieces being contained within a portable workpiece-carrying member which may be loaded and unloaded without interrupting the operation of the lapping machine.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

I claim:

1. In a lapping machine having a rotatable lap plate and a horizontal arm supporting a retaining ring, with the arm and ring movable vertically relative to the lap plate, wherein the improvement comprises a. a pressure pad connected within the retaining ring for limited axial movement therethrough, b. a workpiece carrying member removably carried by said pressure pad for movement therewith, c. means connecting said pressure pad to the horizontal arm, d. means cooperating with said connecting means for rotating said pressure pad about the horizontal axis of the arm, and e. means applying vacuum pressure through said pressure pad and upon said workpiece carrying member to releasably retain said workpiece carrying member and a workpiece carried thereby upon said pressure pad as the latter is rotated about the axis of the horizontal arm.

2. In a lapping machine as defined by claim 1 wherein said removable workpiece carrying member comprises a circular substantially flat tray providing a plurality of recessed workpiece receiving areas, with each of said areas having communication through said pressure pad with said means for applying vacuum pressure thereto.

3. In a lapping machine as defined by claim 2 wherein said workpiece receiving areas formed in said tray contain an insert of porous material which cooperates with said means for applying vacuum pressure through said pressure pad for retaining said tray and a workpiece thereon as said pad is rotated about the horizontal axis of the arm.

4. In a lapping machine as defined by claim 1 wherein said means cooperating with said connecting means for rotating said pressure pad about the horizontal axis of the arm comprises a rack and pinion mechanism.

5. A lapping machine as defined by claim 1 including means cooperating with said means connecting said pressure pad to the horizontal arm for releasably latching said pressure pad in a selected rotated position relative to the horizontal axis of the arm.

6. In a lapping machine as defined by claim 2 including means cooperating with said means connecting said pressure pad to the horizontal arm for releasably latching said pressure pad in a selected rotated position relative to the horizontal axis of the arm.

7. In a lapping machine having a horizontal arm supporting at one end a generally horizontally disposed pressure pad, with the arm and pad rotatable about a horizontal axis, comprising a. means for connecting the pressure pad to one end of the arm for rotational movement therewith, b. a removable tray-like member adapted to sit upon said pressure pad, c. vacuum pressure means applying vacuum pressure through the pressure pad to releasably retain said tray-like member thereon, d. means defining a plurality of workpiece-receiving areas formed in one face of said tray-like member, and e. a porous material extending through said workpiece-receiving areas through which a vacuum is maintained for holding a workpiece within said area and said tray-like member upon the pressure pad during rotation of the arm about said horizontal axis.

8. A lapping machine as defined by claim 7 wherein said means defining a plurality of workpiece-receiving areas comprises a non-porous ring adapted to encircle said porous material so as to retain the same within said tray-like member defining a recessed work-receiving area in one face of said tray-like member for reception of a workpiece therein.

* * * * *